US006743058B1

(12) United States Patent
Cui et al.

(10) Patent No.: US 6,743,058 B1
(45) Date of Patent: Jun. 1, 2004

(54) ELECTRICAL CONNECTOR WITH IMPROVED CONTACTS

(75) Inventors: Hua Nan Cui, Kunsan (CN); Wei Ya Cheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/289,751

(22) Filed: Nov. 6, 2002

(30) Foreign Application Priority Data

Jun. 28, 2002 (TW) ..... 91209759 U

(51) Int. Cl.[7] ..... H01R 13/40

(52) U.S. Cl. ..... 439/733.1; 439/79; 439/83; 439/608; 439/660

(58) Field of Search ..... 439/733.1, 78, 439/83, 607–610, 660, 79

(56) References Cited

U.S. PATENT DOCUMENTS 6,083,051 A 7/2000 Chang
6,132,247 A * 10/2000 Liou et al. ..... 439/567
6,186,830 B1 * 2/2001 Lin et al. ..... 439/607
6,190,183 B1 * 2/2001 Yang et al. ..... 439/79
6,280,206 B1 * 8/2001 Kuroda et al. ..... 439/83
6,371,817 B1 4/2002 Shi et al.
6,447,307 B1 * 9/2002 Wu ..... 439/79
6,482,016 B1 * 11/2002 McHugh et al. ..... 439/79

* cited by examiner

*Primary Examiner*—Truc Nguyen
(74) *Attorney, Agent, or Firm*—Wei Te Chung

(57) ABSTRACT

An electrical connector (1) includes an insulative housing (10) having a front wall (110) and a bottom wall (112) perpendicular to the front wall, and a plurality of conductive contacts (20) received in the housing. Each contact has a contacting portion (22), an engaging portion (21) extending from the contacting portion, a soldering portion (25) and a connecting portion (23) connecting the soldering portion with engaging portion. The connecting portions are hung in the air so that the soldering portions extending from free ends of corresponding connecting portions are elastic to align properly in a common surface.

11 Claims, 5 Drawing Sheets

ELECTRICAL CONNECTOR WITH IMPROVED CONTACTS

BACKGROUND OF THE INVENTION

1. Field of the Invention

The present invention relates to an electrical connector, and more particularly to an input/output (I/O) plug connector having improved contacts providing a reliable solder engagement with a conductive trace of a circuit board.

2. Description of the Prior Art

Input-output (I/O) connectors have been used at connection interfaces between two electrical devices. A typical I/O connector is in the form of an I/O plug adapted for mating with a receptacle connector. Such a plug is, for example, disclosed in U.S. Pat. Nos. 6,083,051. The I/O plug generally has a low-profile mating portion and a plurality of conductive contacts mounted to the mating portion. Each contact has a relative long body portion attached on a surface of the mating portion and a soldering portion extending from the body portion to solder with a circuit board.

However, it is difficult to ensure that all body portions are disposed in a common surface when the surface of the mating portion is not substantially flat. Without coplanar body portions, the soldering potion is uneven which results that an unreliable soldering between the plug and the circuit board.

Hence, an electrical connector with improved contacts is required to overcome the disadvantages of the prior art devices as disclosed above.

SUMMARY OF THE INVENTION

A main object of the present invention is to provide an electrical connector having a plurality of contacts with improved structures to ensure a reliable soldering with a circuit board.

An electrical connector according to the present invention includes an insulative housing having a front wall and a bottom wall perpendicular to the front wall, and a plurality of conductive contacts received in the housing. Each contact has a contacting portion, an engaging portion extending from the contacting portion, a soldering portion and a connecting portion connecting the soldering portion with the engaging portion. The engaging portions engage with the front wall and the connecting portions are disposed above the bottom wall without contacting. The connecting portions are hung in the air so that the soldering extending from free ends of corresponding connecting portions are elastic properly in a common surface.

Other objects, advantages and novel features of the invention will become more apparent from the following detailed description when taken in conjunction with the accompanying drawings.

DETAILED DESCRIPTION OF THE INVENTION

Figure 1:
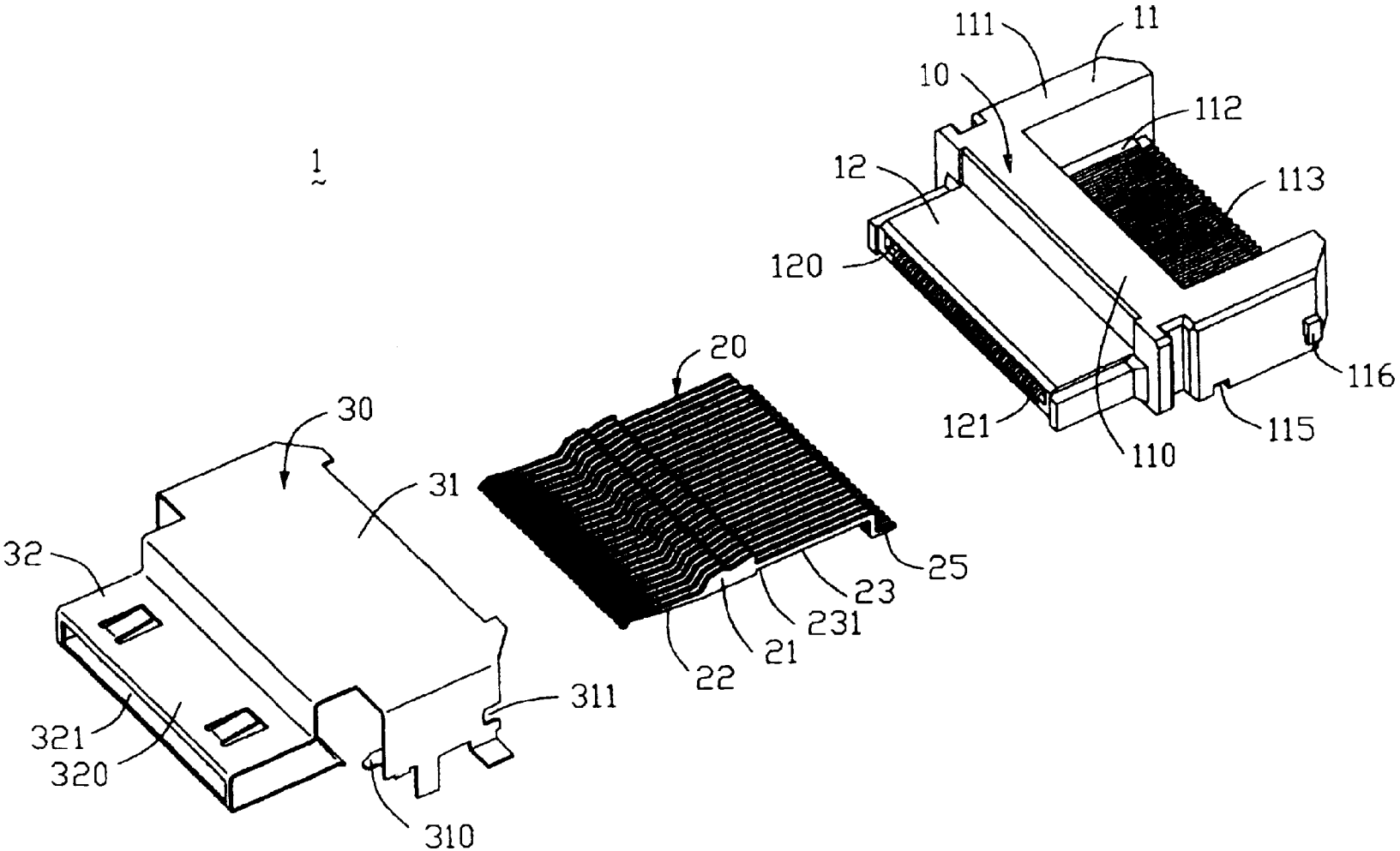
FIG. 1 is an exploded perspective view of an electrical connector according to the present invention.
Figure 2:
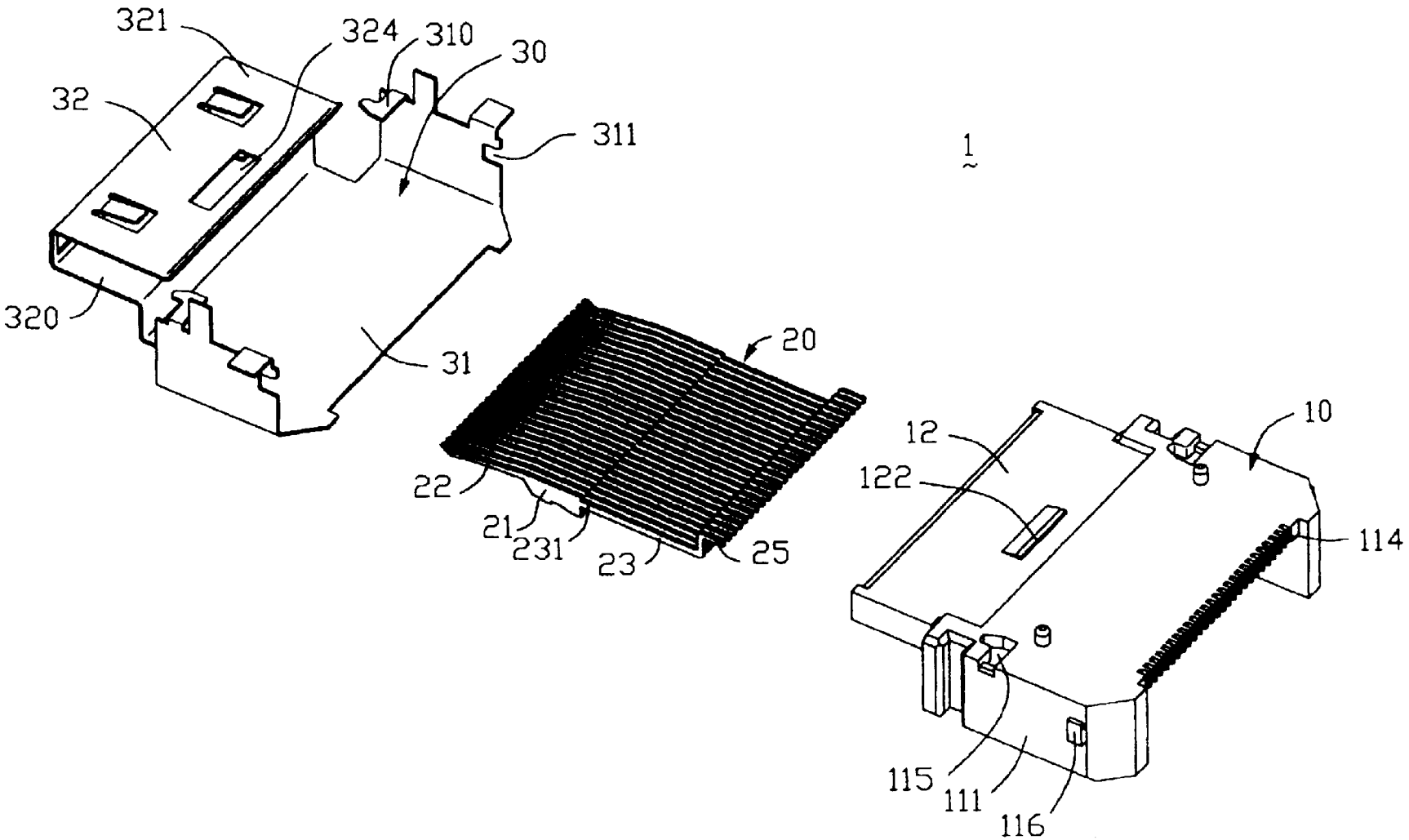
FIG. 2 is another exploded perspective view of the connector of FIG. 1.

Referring to the drawings and particularly to FIGS. 1 and 2, an electrical connector 1 in accordance with the present invention comprises an insulative housing 10, a plurality of conductive contacts 20 and a metallic shell 30.

The housing 10 comprises a body portion 11 and a low profile mating portion 12 extending forwardly from a front surface of the body portion 11. The body portion 11 includes a front wall 110, a pair of side walls 111 extending rearwardly from opposite ends of the front wall 110 and a bottom wall 112. The; mating portion 12 defines a receiving cavity 120 therethrough. A row of second; passageways 121 are defined in a lower wall (not labeled) of the mating portion 12, communicating with the receiving cavity 120. A row of first passageways 113 are defined in the bottom wall 112 and communicate with the receiving cavity 120 and corresponding second passageways 121 though the front wall 110. A plurality of vertical passageways 114 are defined in a rear side of the bottom wall 112 and communicate with corresponding first passageways 113.

A pair of notches 115 are defined in a bottom surface of the bottom wall 112. A pair of tabs 116 respectively protrudes from the pair of side walls 111. A barb 122 is formed on a bottom surface of the mating portion 12.

Each contact 20 has a contacting portion 22, a engaging portion. 21 extending rearwardly from a rear end of the contacting portion 22, a soldering, portion 25, and a connecting portion 23 connecting a rear end of the engaging portion with an upper end of the soldering portion 25. A plurality of protrusions. (not labeled) are formed on an upper side of each engaging portion 21. A lower side of each connecting portion 23 is higher than a lower side of a corresponding engaging portion 21. The soldering portion 25, the connecting portion 23 and the engaging portion 21 together define a recess 231.

The metallic shell 30 has a head portion 32 including an upper panel 320 and a lower panel 321 parallel to the upper panel 320. A body panel 31 extends rearwardly from the upper panel 320 and includes a pair of locking portions 310 and a pair of cutouts 311. An opening 324 is defined in the lower panel 321.

Figure 3:
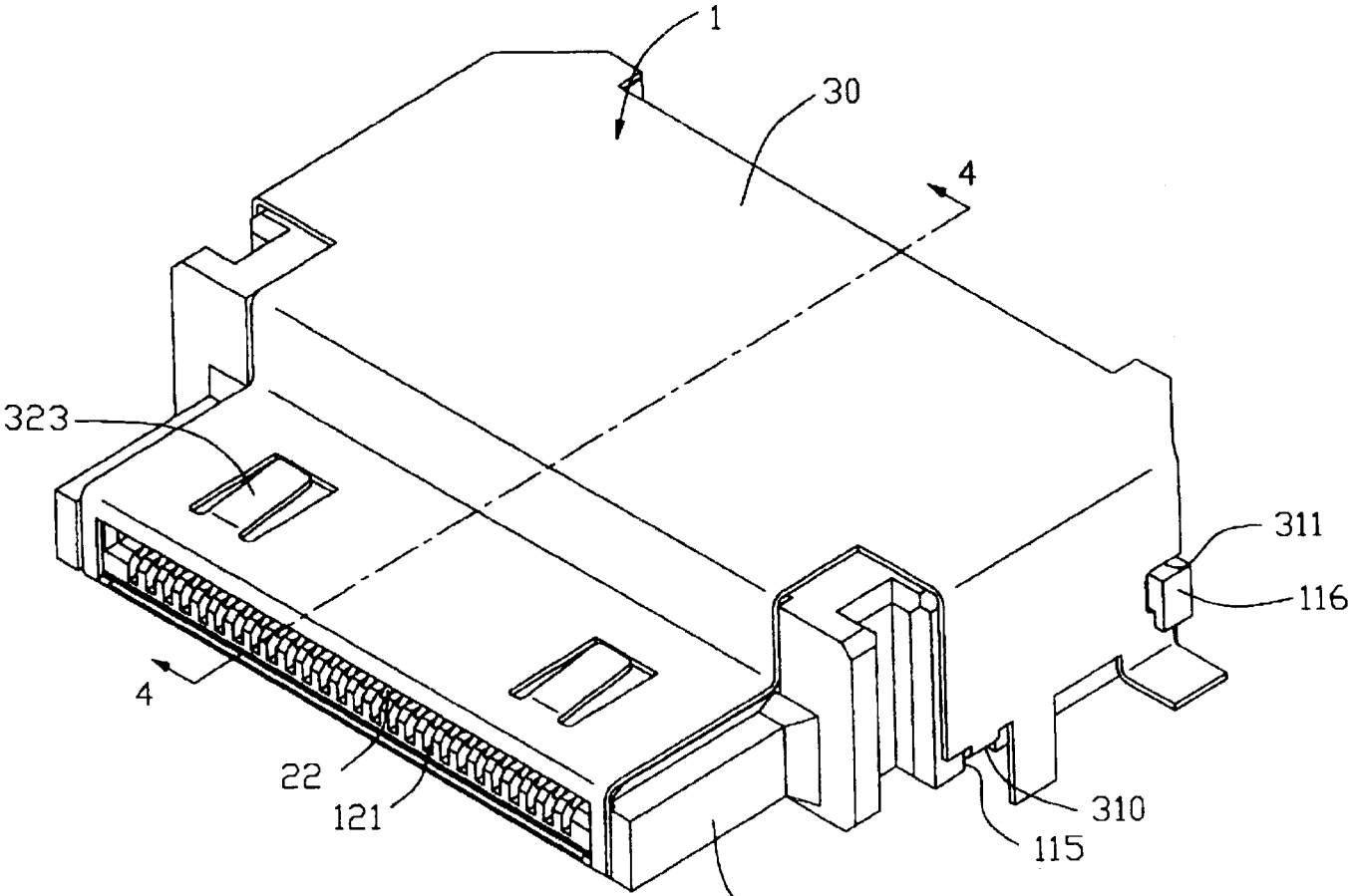
FIG. 3 is an assembled view of FIG. 1.
Figure 4:
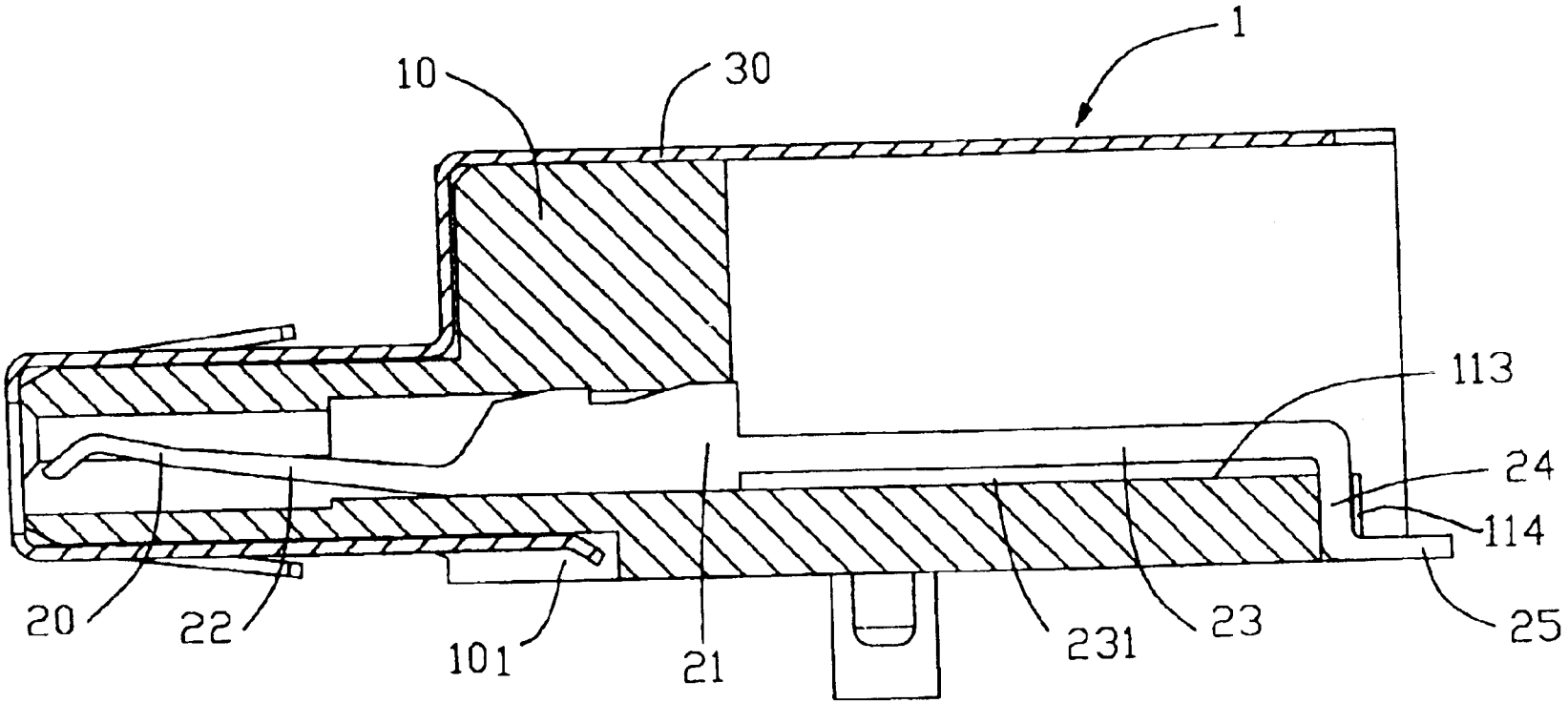
FIG. 4 is a cross-sectional view taken along a line 4—4 of FIG. 3.

Referring to FIGS. 3 and 4, in assembly, the contacts 20 are inserted into the housing 10, with the contacting portions 22 received in corresponding second passageways 121, the connecting portions 23 received in corresponding, first passageways 113 and the vertical section 24 of the soldering portions 25 received in corresponding vertical passageways 114. The engaging portions 21 engage with the front wall 110 to secure the contacts 20 in the housing 10 stably. The recesses 231 separate the connecting portions 23 from an upper surface of the bottom wall 112, so that the upper surface of the bottom wall 112 has no effect on the positions of the connecting portions 23 and the soldering portions 25. The connecting portions 23 are hung in the air so that the soldering portions 25 are elastic to align properly in a common surface and the soldering portions 25 can be soldered to a circuit board (not shown) stably.

The metallic shell 30 shields the housing 10 and the contacts 20, with the upper and lower panels 320, 321 respectively abutting against a top and the bottom surfaces of the mating portion 12 of the housing 10 with a distal end portion of the lower panel 321 received in the recess 101 of the body portion 11 and the body panel 31 covering the body portion 11. The pair of locking portions 310 are received in corresponding notches 115 and the pair of cutouts 311 engage with corresponding tabs 116. The opening 324 engages with the barb 122.

Figure 5:
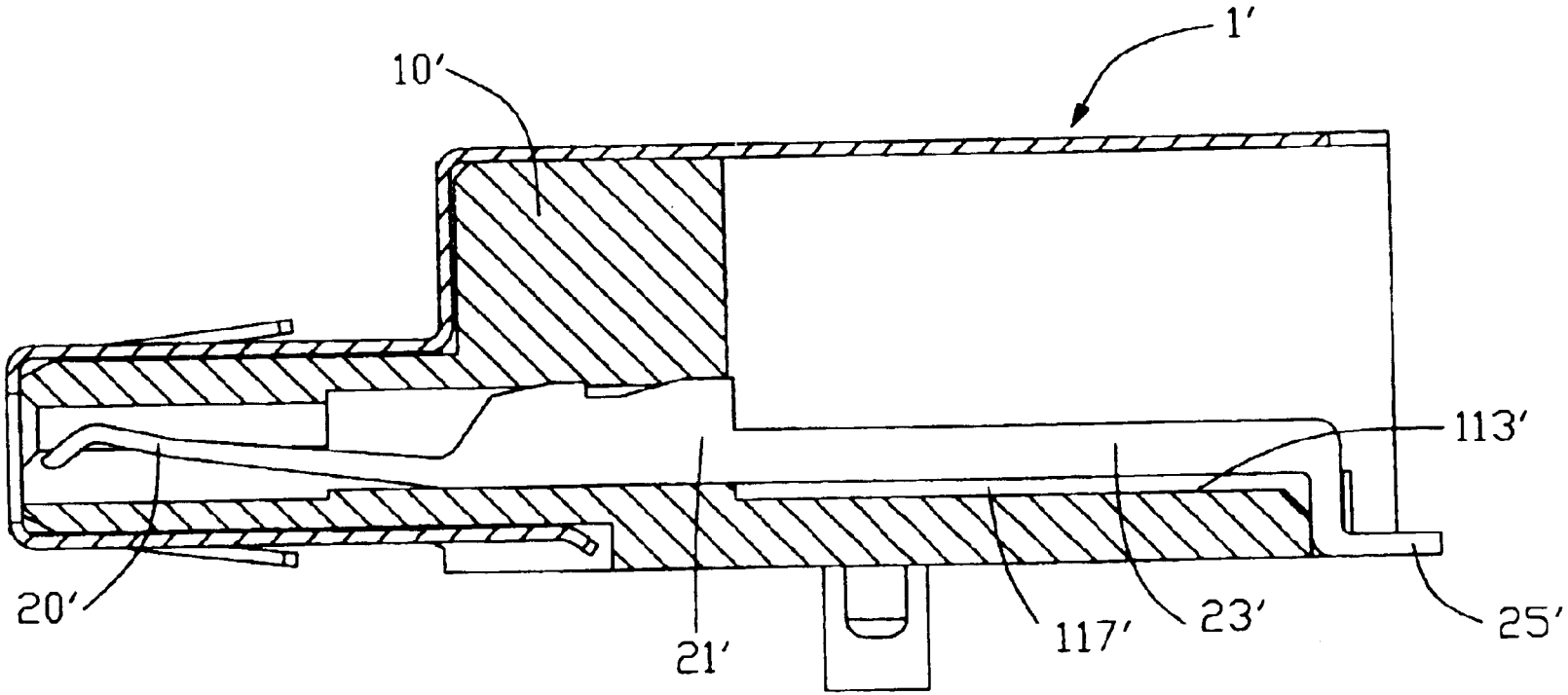
FIG. 5 is a cross-sectional view of another embodied electrical connector according to the present invention.

FIG. 5 shows an electrical connector 1' as another embodiment of the present invention, which is similar to the electrical connector 1. The connector 1' includes an insulative housing 10' and a plurality of conductive contacts 20' received in the housing 10'. Each contact 20' has a contacting portion (not labeled), an engaging portion 21' extending from the contacting portion, a connecting portion 23' extending from the engaging portion 21', and a soldering portion 25' extending from the connecting portion 23'. A lower side of each engaging portion 21' align with that of a corresponding connecting portion 23'. The housing 10' defines a plurality of first passageways 113' receiving corresponding horizontal connecting portions 23'. A plurality of dimples 117' are defined in an upper surface of the housing 10' and in corresponding first passageways 113' to separate, the connecting portion 23' from the upper surface.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector comprising:

an insulative housing having a front wall defining a plurality of receiving cavities, and a bottom wall perpendicular to the front wall, the bottom wall defining a plurality horizontal and vertical of passageways therein;

a plurality of conductive contacts received in the housing, each contact having a contacting portion, an engaging portion extending from the contacting portion, a soldering portion and a connecting portion connecting the soldering portion with the engaging portion, the engaging portions engaging with the front wall, the connecting portions disposed above the bottom wall without contacting the connecting portion of the adjacent conductive contact and received in corresponding passageways;

wherein the each of the plurality of the horizontal passageways continuously extending along an upper surface of the bottom wall and communicating with the corresponding receiving cavity through the front wall.

2. The electrical connector as claimed in claim 1, wherein the housing includes a mating portion extending forwardly from the front wall, a receiving cavity defined through the mating portion.

3. The electrical connector in claim 1, wherein the contacting portion of the contacts are received in the receiving cavity, the engaging portions are secured in the front wall and the connecting portion are received in corresponding passageways.

4. The electrical connector as claimed in claim 1, further comprising a metallic shield shielding the housing and the contacts.

5. The electrical connector as claimed in claim 1, wherein the bottom wall rearwardly extends from a rear face of the front wall with a distance, along a front-to-back direction, not less than a dimension of a mating portion of said housing along said front-to-back direction.

6. The electrical connector as claimed in claim 3, wherein the connecting portions are hung in the air so that the soldering portions extending from free ends of corresponding connecting portions are elastic to align properly in a common surface.

7. The electrical connector as claimed in claim 5, wherein said solder portion includes a vertical section joined with the connection portion, and said vertical section is retainably received in a corresponding vertical passageway formed in a rear face of said bottom wall.

8. An electrical connector comprising:

an insulative housing having a front wall defining a plurality of receiving cavities, and a bottom wall perpendicular to the front wall, the bottom wall defining a plurality of horizontal and vertical passageways therein;

a plurality of conductive contacts received in the housing, each contact having a contacting portion, an engaging portion extending from the contacting portion, a soldering portion and a connecting portion connecting the soldering portion with the engaging portion, the engaging portion engaging with the front wall, the connecting portion floatable received in corresponding passageways and the soldering portion floatable supported within the housing;

wherein the each of the plurality of the horizontal passageways continuously extending along an upper surface of the bottom wall and communicating with the corresponding receiving cavity through the front wall.

9. The electrical connector as claimed in claim 8, wherein the connecting portions are disposed above the bottom wall and a portion of the connecting portion adjacent to the soldering portion are hung in the air so that the soldering portions extending from free ends of corresponding connecting portions are elastic to align properly in a common surface.

10. The electrical connector as claimed in claim 8, wherein each connecting portion has a lower side higher than a lower side of a corresponding engaging portion.

11. The electrical connector as claimed in claim 8, wherein the housing defines a plurality of dimples in corresponding passageways.

* * * * *